United States Patent [19]

Gillette

[11] Patent Number: 4,943,062

[45] Date of Patent: Jul. 24, 1990

[54] RANDOM INDICIA SELECTOR

[76] Inventor: Richard A. Gillette, 8567 Pomelo Tree La., Orlando, Fla. 32819

[21] Appl. No.: 275,437

[22] Filed: Nov. 23, 1988

[51] Int. Cl.[5] ..... A63F 9/04

[52] U.S. Cl. ..... 273/144 B; 273/145 C; 273/146

[58] Field of Search ..... 273/145 C, 145 CA, 146, 273/144 R, 144 B

[56] References Cited

U.S. PATENT DOCUMENTS

| | | | |
|---|---|---|---|
| 386,577 | 7/1888 | De Grain | 273/145 C |
| 2,945,312 | 7/1960 | Book | 40/503 |
| 3,208,754 | 9/1965 | Sieve | 273/146 |
| 4,345,761 | 8/1982 | China | 273/146 |
| 4,533,143 | 8/1985 | Albright et al. | 273/144 B |

FOREIGN PATENT DOCUMENTS

| | | | |
|---|---|---|---|
| 259924 | 11/1927 | United Kingdom | 273/156 |

*Primary Examiner*—Anton O. Oechsle

*Attorney, Agent, or Firm*—Merrill N. Johnson

[57] ABSTRACT

A housing contains a plurality of tetrahedron shaped dice. The faces of the dice bear one or more indicia. The housing includes a tumbling compartment in which all of the dice are shaken and a smaller plurality of pyramidal shaped cavities in which certain of the dice are then disposed for viewing. At least a portion of one face of each die is visible through the wall of the housing in one embodiment, while at least a portion of two faces of each die is visible in another embodiment.

13 Claims, 1 Drawing Sheet

RANDOM INDICIA SELECTOR

BACKGROUND OF THE INVENTION

1. Field of the Invention

This invention relates generally to devices for randomly selecting and displaying a predetermined number of indicia marked dice from a quantity of such dice, and more particularly to a random indicia selector utilizing dice in the form of regular tetrahedrons.

2. Description of Related Art

Numerous games have been devised which involve a step of randomly assigning to the players certain indicia bearing markers from a group of such markers. Thus cards may be dealt or dice rolled so that chance determines the result. Similarly, a number of states have sponsored games of chance as a method of raising revenue without the imposition of a tax. These games often require a player to choose a group of numbers to play. Although some players of these games of chance have favorite numbers which they play, other players prefer the random selection of numbers.

A number of patents disclose containers in which a quantity of balls are shaken in one volume and then a predetermined number of the balls are displayed in channels or pockets adjacent to the shaking volume. U.S. Pat. Nos. 2,185,366; 3,304,091; 3,679,211; 4,273,335; 4,368,887; 4,403,775; 4,465,278; 4,509,755 and 4,530,503 are representative of such containers.

In addition, dice having variously marked faces or portions of faces have been devised as shown in U.S. Pat. Nos. 4,239,226; 4,436,306; 4,497,487 and 4,678,190.

The present random indicia selector is a housing configured to be held comfortably while regular, tetrahedron shaped dice are shaken in a tumbling chamber. A predetermined number of these dice are then permitted to fall into pyramidal cavities where a face, or a portion of a face is displayed for viewing.

SUMMARY OF THE INVENTION

A plurality of identically sized dice having the configuration of regular tetrahedrons have each face or portions of each face marked with indicia. The use of a tetrahedron permits various marking arrangements. Thus, all faces of a die can be marked with the same indicia, each face may be marked with different indicia or a portion of each face may be marked with the same or different indicia.

The dice are contained in a housing having a tumbling compartment and a number of pyramidal shaped displaying cavities. These cavities are designed so that only one face or a portion of one face of a die can be seen. Flexibility in achieving the desired number of indicia in a manner to assure randomness results from using one or the other of the display modes, different numbers of dice and different numbers of displaying cavities.

It is therefore an object of this invention to provide a random indicia selector which will provide equal opportunities for any of a plurality of indicia to be displayed.

It is also an object of this invention to provide a random indicia selector which contains dice configured as regular tetrahedrons.

It is a further object of this invention to provide a housing design which can readily be expanded or contracted to provide a desired number of displayed indicia.

In accordance with these and other objects, which will become apparent hereafter, the instant invention will now be described with reference to the accompanying drawings.

DETAILED DESCRIPTION OF THE INVENTION

Figure 1:
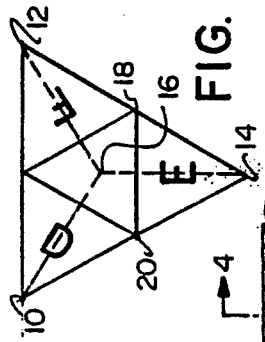
FIG. 1 is a plan view of one face of a die of the type used in the invention.

Referring to FIG. 1, a die in accordance with the invention is represented having vertices 10–16. Any three vertices, such as 10, 12 and 14 are the end points of edges which define a face or facet of the die. As will be described below, when the die is positioned for display, a vertex will be down, such as vertex 14 in FIG. 1. The display may be arranged so that only a portion of the face, such as the portion labeled "E" lying between the boundaries 14–20, 20–18 and 18–14, is visible. With such an arrangement, it is possible to have three indicia on each face, e.g. "E", "F" and "D". It should be noted that for many purposes these three indicia may be identical. It would also be possible to display a complete face; however, the displayed indicia would not necessarily be displayed upright. Moreover, the other three faces or facets may be labeled with the same indicia as on the face displayed, or these facets may bear different indicia.

Figure 4:
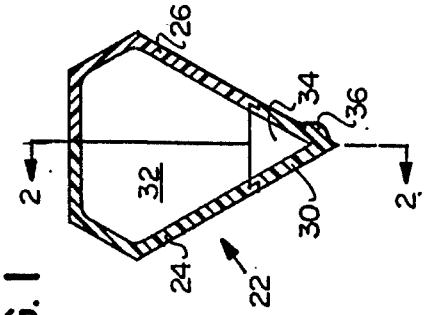
FIG. 4 is a cross-sectional side elevation taken on the line 4—4 of FIG. 2.
Figure 2:
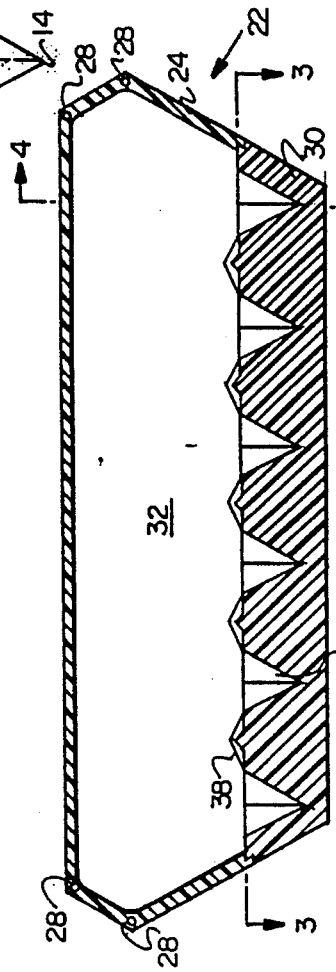
FIG. 2 is a cross-sectional elevation of a housing in accordance with the invention taken on the lines 2—2 of FIGS. 3 and 4.
Figure 3:
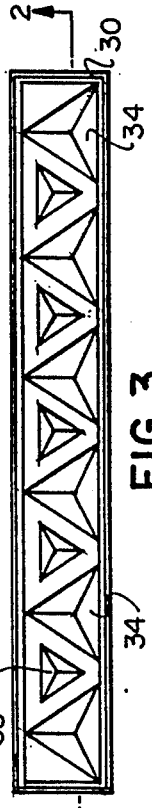
FIG. 3 is a plan view of the bottom piece of the housing of FIG. 2.

Referring now to FIGS. 2–4, housing 22 is formed of three pieces which are preferably molded plastic. The upper portion is made of two symmetrical halves 24, 26. These halves are joined by pins 28 which fit into complementary holes. When halves 24, 26 are brought together, bottom piece 30 is fitted between them and held in position by the mated halves.

The three pieces form an upper tumbling compartment 32 in which the desired plurality of dice as described with respect to FIG. 1 are placed during assembly. In use, housing 22 is shaken with bottom piece 30 held upward so that all the dice are in tumbling compartment 32. After the dice have been shaken, housing 22 is turned so that bottom piece 30 is down.

Bottom piece 30 has six pyramidal cavities 34 which are sized to receive a die. Preferably, these cavities are slightly larger than a die so that the die will readily fall out of the cavity when the housing is inverted again. The number of such cavities can be varied by changing the space between them or the overall length of the housing. The cavities are oriented so that one face of the die will be parallel to a face of bottom piece 30 for viewing. As shown in FIG. 4 this viewing can be enhanced by forming bottom piece 30 to have a lens structure adjacent to the die face area. Bottom piece 30 may also have on its upper surface, raised pyramidal mounds 38 to aid in the positioning of the dice in cavities 34. At least the portions of bottom piece 30 which include lens 36 should be formed of transparent plastic. As shown in FIG. 4, lens 36 only extends part way up the side of bottom piece 30. This is for the case where the dice used are the type depicted in FIG. 1 and only the bottom-most portion is to be displayed.

Figure 5:
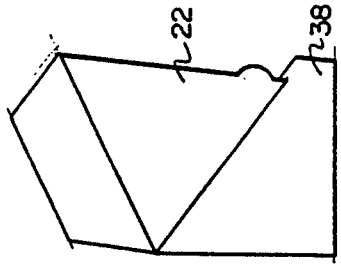
FIG. 5 is an end view of a random indicia selector positioned in a support.

FIG. 5 depicts support 38 which is designed to hold housing 22 in a substantially upright position for viewing. Such a support may be especially desirable in a game where it is desired to retain the displayed dice in position for an interval.

Figure 6:
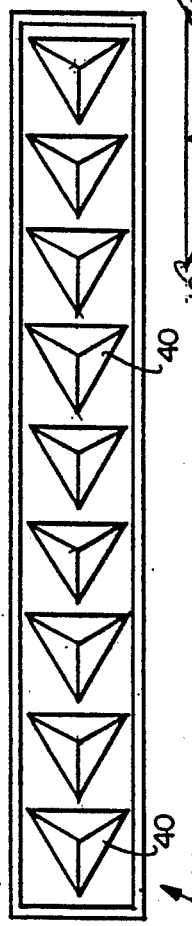
FIG. 6 is a plan view of an alternate bottom piece embodiment.
Figure 7:
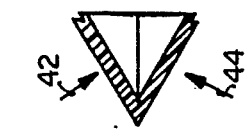
FIG. 7 is a partial cross-section of the bottom piece of FIG. 6.

The foregoing structure is designed to display only one face, or a portion of one face, of a die. For some purposes, it may be desired to show two faces (or portions thereof) of a die. Turning to FIGS. 6 and 7, it is seen that the dice receiving cavities 40 are oriented so that two faces may be displayed and viewed as indicated by arrows 42 and 44.

The use of tetrahedron shaped dice in conjunction with the housing which may be fabricated to display any desired number of dice by using the appropriate number of display cavities results in a versatile random indicia selector. The structure also is pleasing to look at and comfortable to hold.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A random indicia selector comprising:

a housing containing a tumbling compartment;

a first plurality of identically sized, regular tetrahedron shaped dice bearing indicia on each face contained in said housing;

a second plurality of pyramidal shaped display cavities along one side of said tumbling compartment;

said housing sized so all of said first plurality of said dice may be tumbled about at least two axes in said tumbling compartment and a random second plurality of said dice may then be disposed in said display cavities.

2. A random indicia selector in accordance with claim 1 wherein:

said housing tapers outwardly and upwardly from a substantially pointed bottom edge.

3. A random indicia selector in accordance with claim 2 wherein:

said taper defines an included angle of substantially sixty degrees.

4. A random indicia selector in accordance with claim 1 wherein:

one face of each display cavity is oriented to be parallel to a face of said housing.

5. A random indicia selector in accordance with claim 1 wherein:

each display cavity is oriented to display at least a portion of two faces of a die positioned therein.

6. A random indicia selector in accordance with claim 1 further including:

a support configured to hold said housing substantially upright.

7. A random indicia selector in accordance with claim 1 wherein:

said housing is formed of two symmetrical upper halves and a bottom piece; and said pyramidal cavities are formed in said bottom piece.

8. A random indicia selector in accordance with claim 7 wherein:

said two symmetrical upper halves and said bottom piece are molded plastic.

9. A random indicia selector in accordance with claim 7 wherein:

said bottom piece includes raised pyramidal mounds between said pyramidal cavities.

10. A random indicia selector in accordance with claim 4 wherein:

only a bottom portion of a die contained in a cavity is visible through transparent areas of said housing.

11. A random indicia selector in accordance with claim 8 wherein:

said housing is formed to provide an enlarging lens adjacent to said transparent areas.

12. A random indicia selector in accordance with claim 1 wherein:

each die face has three portions and each portion bears indicia.

13. A random indicia selector comprising:

a housing containing a tumbling compartment and a plurality of pyramidal shaped cavities;

a second, larger plurality of tetrahedron shaped dice sized to fit within said cavities;

said housing sized so all of said second plurality of said dice may be tumbled about at least two axes;

each of said dice having faces with three portions with each portion of each face bearing indicia;

said cavities being so oriented and fabricated that only one said portion of one face of a die is displayed when said die is disposed in one of said cavities.

* * * * *